US006105879A

United States Patent [19]

Potz et al.

[11] Patent Number: 6,105,879

[45] Date of Patent: Aug. 22, 2000

[54] FUEL INJECTION VALVE

[75] Inventors: Detlev Potz, Stuttgart; Stephan Haas, Mammendorf; Thomas Kuegler, Korntal-Muenchingen, all of Germany

[73] Assignee: Robert Bosch GmbH, Stuttgart, Germany

[21] Appl. No.: 09/297,825

[22] PCT Filed: Feb. 27, 1998

[86] PCT No.: PCT/DE98/00575

§ 371 Date: Jun. 10, 1999

§ 102(e) Date: Jun. 10, 1999

[87] PCT Pub. No.: WO99/13214

PCT Pub. Date: Mar. 18, 1999

[30] Foreign Application Priority Data

Sep. 11, 1997 [DE] Germany ..... 197 39 905

[51] Int. Cl.[7] ..... F02M 47/02

[52] U.S. Cl. ..... 239/88; 239/90; 239/93; 239/95; 239/96; 239/124; 239/533.7

[58] Field of Search ..... 239/88, 89, 90, 239/91, 92, 93, 94, 95, 96, 124, 533.7

[56] References Cited

U.S. PATENT DOCUMENTS 2,762,654 9/1956 Purchas, Jr. et al. ..... 239/533.7 X 4,182,492 1/1980 Albert et al. ..... 239/92

5,275,337 1/1994 Kolarik et al. ..... 239/91

FOREIGN PATENT DOCUMENTS 4444363 6/1996 Germany .

*Primary Examiner*—Andres Kashnikow

*Assistant Examiner*—Robin O. Evans

*Attorney, Agent, or Firm*—Ronald E. Greigg; Edwin E. Greigg

[57] ABSTRACT

A fuel injection valve for internal combustion engines, having a valve member that emerges outward from the valve body. At least two rows of injection ports one above the other are provided on the valve member, in the outward-oriented opening stroke of the valve member the injection parts are uncovered in secession. A two-stage hydraulic stroke stop, which limits the opening stroke travel of the valve member is embodied as a hydraulic damping chamber with openable relief. This relief is effected via at least two polished sections on the valve member which are openable in succession during the opening stroke motion of the valve member. At least one of the polished sections is connected to a low-pressure chamber, via a relief conduit containing a valve.

28 Claims, 6 Drawing Sheets

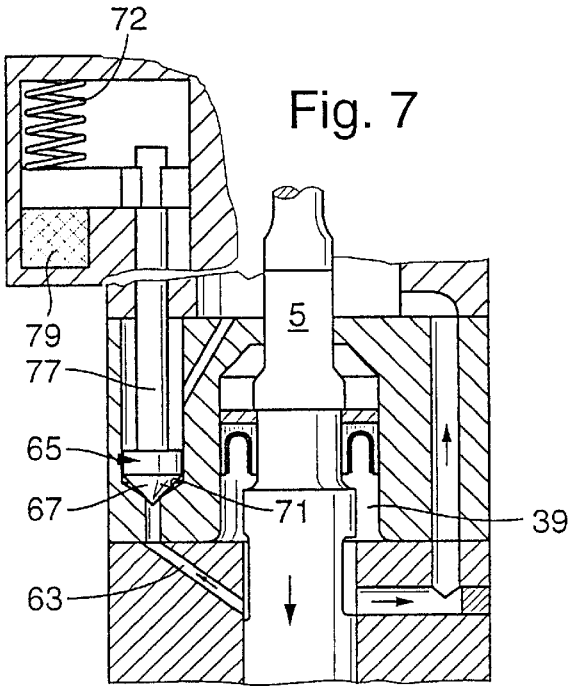
Fig. 7
Fig. 8
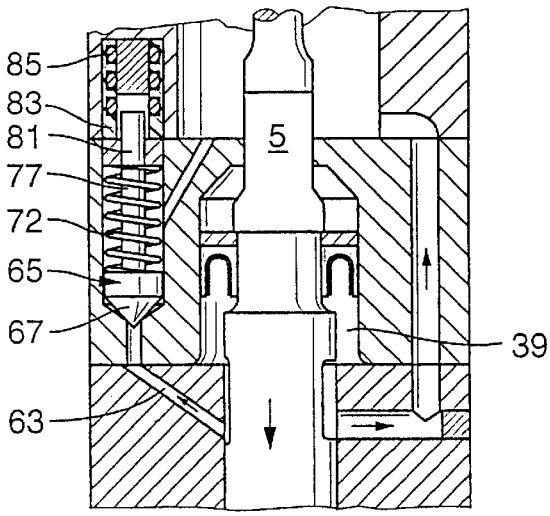
Fig. 9
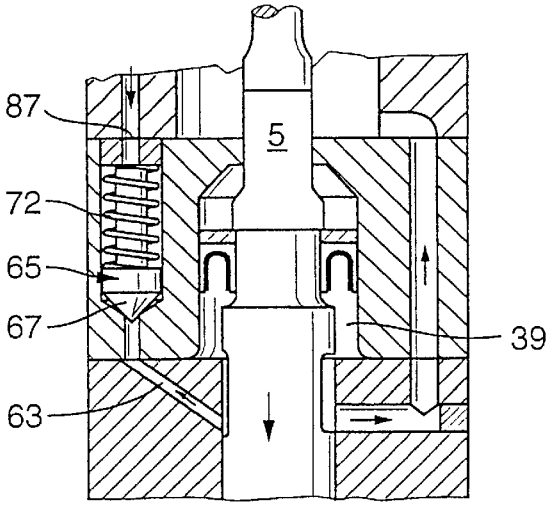

FUEL INJECTION VALVE

PRIOR ART

The invention is based on a fuel injection valve for internal combustion engines. In one such fuel injection valve, known from the earlier German Patent Application, Serial No. DE 196 42 440.2, a pistonlike valve member can be displaced axially outward to a restoring spring in a bore of the valve body that protrudes into the combustion chamber. On its end toward the combustion chamber, the valve member has a closing head that protrudes out of the bore and forms a valve closing member and that on its end toward the valve body has a valve sealing face. With this valve sealing face, the valve member cooperates with a valve seat face disposed on the face end, toward the combustion chamber, of the valve body. Two rows of injection openings disposed one above the other are also provided on the closing head of the valve member; their outlet openings are covered in the closing direction of the valve member by the valve body and are uncovered in succession in the outward-oriented opening stroke. For defined uncovering of the individual rows of injection ports, the known fuel injection valve has a two-stage hydraulic stroke stop, which limits the opening stroke travel of the valve member and is embodied as a hydraulic damping chamber with openable relief. The relief line can be made to communicate with the damping chamber via two recesses on the valve member, and this communication can be opened in succession during the opening stroke motion of the valve member. To that end, the recesses in the known fuel injection valve are embodied as two plane polished sections on the valve member, which with their upper ends protrude into the damping chamber. The upper ends of the polished sections form control edges, which emerge successively from the coincidence with the damping chamber during the opening stroke motion of the valve member and are closed by the wall of the valve body. A first polished section communicates constantly, by its lower end, with the relief line, while the second polished section, with its lower boundary edge, does not plunge into the coincidence with the relief line until after a certain opening stroke motion has been traversed. In this way, in the known fuel injection valve, a two-staged hydraulic blocking of the valve member is attained; a first opening position at the damping chamber corresponds to the opening of the first row of injection ports, while the final, hydraulically blocked terminal position of the valve member corresponds to the opening of the two rows of injection ports and thus the opening of the entire injection cross section.

The known fuel injection valve has the disadvantage, however, that the recesses on the valve member must be made with great precision, in order to assure accurate uncovering of the rows of injection ports via the precise disposition of the many control edges. Furthermore, in the known fuel injection valve, the injection-pressure-dependent blocking of the valve member in intermediate positions cannot be set in an operationally dictated way, which means that complicated geometric adaptation work must be done for the hydraulic stroke stops. Thus the requisite control, for the so-called varioregister nozzles, of a multistage opening stroke course of the valve member as a function of the fuel injection pressure prevailing at the valve can be achieved only at very great engineering effort and expense.

ADVANTAGES OF THE INVENTION

The fuel injection valve of the invention for internal combustion engines, has the advantage over the prior art that the second opening stroke phase of the valve member is settable and controllable via a valve inserted into the relief line.

Furthermore, a third control edge that controls the onset of the second opening stroke phase can be dispensed with, so that the engineering effort and expense for the recesses on the valve member can be greatly reduced compared with the known embodiment. Reducing the control edges also brings about stable long-term operational performance because of the reduced variabilities as a consequence of geometric imprecisions at the control recesses. The embodiment of the recesses according to the invention has the further advantage that both control edges are disposed at the upper end of the recesses and are thus easy to make. The instant of onset of the second opening stroke phase of the valve member can be set in a simple way by means of the design of the bore diameter of the relief line and of the valve embodiment, such as the design of the valve spring strength for the valve in the relief line.

However, it is especially advantageous to be capable of setting the opening instant or closing characteristic of the valve, preferably embodied as a pressure valve, in the relief line during injection valve operation as a function of a performance graph, so that the second opening stroke phase at the valve member of the injection valve can be controlled continuously. To that end, the pressure valve can advantageously be triggered directly by an electric final control element, which may for instance be embodied as a piezoelectric actuator. A further alternative is the direct connection of the valve member of the pressure valve with the armature in a coil through which current flows (magnet valve); the basic settings can be made in each case via a spring. The direct control of the pressure valve in the relief line can also be done hydraulically; a regulated hydraulic counterpressure is provided on the back side of the pressure valve, and by means of it the pressure valve can be opened or closed as a consequence of the pressure difference between the pressure upstream of the pressure valve and the counterpressure downstream of pressure valve.

A further advantageous possibility of setting the valve in the relief line is the performance-graph-controllable adjustment of the spring prestressing of the valve spring of the pressure valve. The spring prestressing can be set continuously by means of an adjustable spring bearing face, which can be displaced axially, for instance electrically by a piezoelectric actuator or the armature in a magnet coil or hydraulically by a piston of a work chamber. To assure reliable refilling with fuel of the damping chamber acting as a control chamber during the closing motion of the valve member of the injection valve, a check valve is advantageously also inserted into an in line of the damping chamber, and this line communicates on the other side with the low-pressure fuel loop, preferably the spring chamber of the injection valve. This check valve moreover prevents a negative pressure from arising in the damping chamber and thus prevents cavitation damage and unintended vibration of the injection valve member afterward upon closure.

Another advantageous alternative embodiment of the valve in the relief line is its embodiment as a deflection piston. The valve member, embodied as a deflection piston, of the valve in the relief line, upon its opening stroke motion, makes a defined deflection volume available, by which the pressure in the damping chamber of the injection valve drops and thus makes the second opening stroke travel possible. This variable embodiment has the advantage that the control volume in the closing stroke of the injection valve member is replenished in a simple way from the deflection volume. The pressure drop in the damping chamber can furthermore be limited precisely, and as a result upon the final closure of the damping chamber when the final stroke position of the injection valve member is reached, the pressure can be built up faster, which shortens the stopping distance of the valve member of the injection valve. Another advantage of this variant is that the sealing function of the deflection volume to the leakage oil space (for instance, the spring chamber) through the jacket face of the deflection piston and from the relief line to the deflection volume is assured by a conical seat.

Another advantage is attained by the oblique embodiment of the upper ends of the plane polished sections in the valve member, which accomplish a gradual closing of the opening cross section to the damping chamber and thus prevent pressure oscillations and resultant vibration at the valve member.

To assure emergency operation properties at the fuel injection valve that are required for the initial filling of the damping chamber, the valve spring is designed to be secure against blocking.

A further advantage is attained by disposing the damping chamber in a shim that is fastened between the valve body and a valve holding body, making relatively simple production or manufacture of the damping chamber and the relief conduit possible.

The damping or control chamber is defined, on its axial end opposite the end face of the valve body, by a piston, which is advantageously formed by a sealing ring press-fitted onto the valve member. This sealing ring secured to the valve member slides sealingly with its outer circumference in a bore, forming the damping chamber, in the shim. The sealing ring is advantageously embodied as a U-shaped sealing ring which is open toward the damping chamber and is preferably made of a PTFE material. A spring for basic sealing is also placed in this sealing ring, and because of the U-shaped hollow profile, the sealing off of the sealing ring from the wall of the shim is increased as the hydraulic pressure in the damping chamber rises. A relief conduit that relieves the damping chamber is also advantageously integrated with the shim; furthermore, the pressure valve that controls this relief conduit is provided in the shim. This pressure valve is advantageously embodied as a piston check valve, and via the design of the pressure valve spring, the opening pressure or opening instant can be set as the onset of the second valve member opening stroke phase. A throttle restriction is advantageously also located upstream of the pressure valve. Advantageously, the stroke of the piston in the pressure valve is limited to the minimum stroke necessary, and furthermore the piston is made from lightweight materials, to keep wear and vibration of the pressure valve as low as possible.

To assure a secure connection between the plane polished sections and the relief conduit, it is necessary to secure the valve member against independent torsion. This torsion preventing means is advantageously disposed in a region of low stress, preferably between the upper valve member guide and the fuel injection valve spring, or between this spring and the end of the valve member. To that end, the valve member has recesses, preferably an even number of polished sections, which engage a molded part, disposed in the valve body holder, that has complementary integrally formed portions. This molded part can easily be adapted to the actual location of the valve member during the assembly of the fuel injection valve and thus makes an only slight spacing between the valve member and the rotary position fixing means possible, thus making very precise guidance with little wear to the valve member possible. It is especially advantageous for this molded part to be integrated with the shim between the valve body and the valve holding body.

Further advantages and advantageous features of the subject of the invention can be learned from the specification, drawing and claims.

BRIEF DESCRIPTION OF THE DRAWINGS

Nine exemplary embodiments of the fuel injection valve of the invention for internal combustion engines are shown in the drawing and will be described in further detail in the ensuing description.

FIG. 7 shows a second exemplary embodiment, analogous to the view of FIG. 3, in which the valve in the relief line is directly controlled via a piezoelectric actuator;

FIG. 8 shows a third exemplary embodiment, in which the valve member is actuated by a magnetic valve;

FIG. 9 shows a fourth exemplary embodiment, in which the opening of the valve in the relief line is settable by means of a hydraulic counterpressure on the pressure valve;

DESCRIPTION OF THE EXEMPLARY EMBODIMENTS

Figure 1:
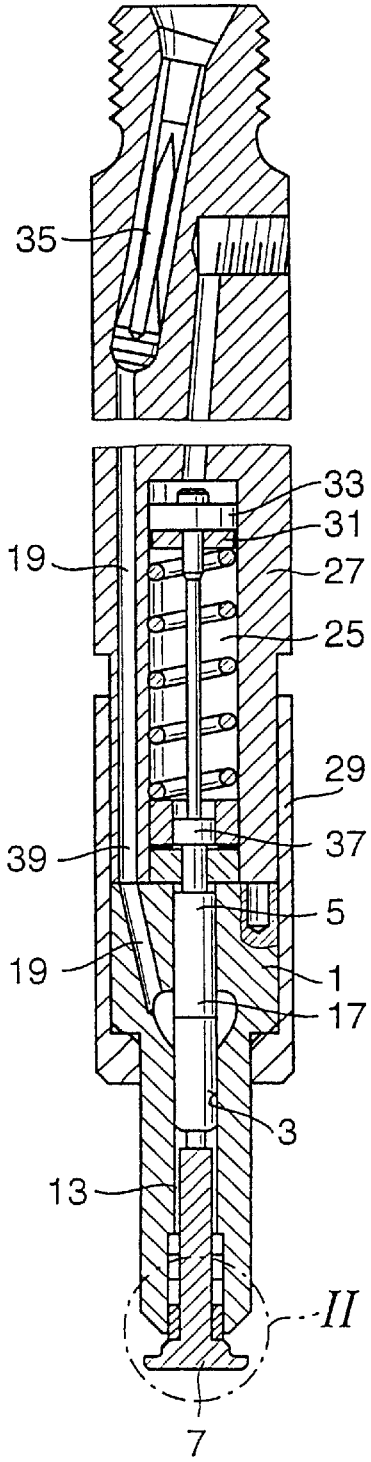
FIGS. 1 and 2 show a known fuel injection valve of the varioregister nozzle type in various sectional views.
Figure 2:
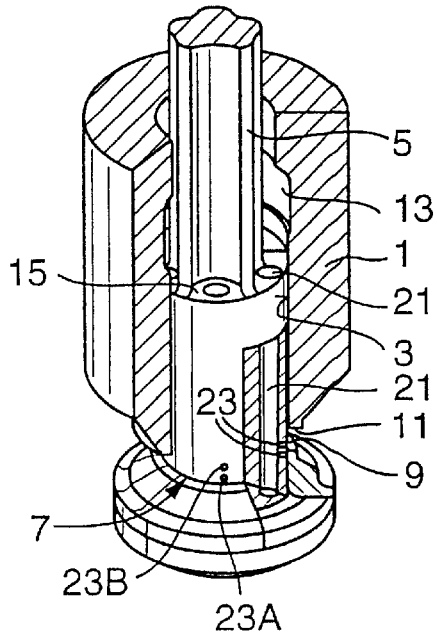

FIGS. 1 and 2 show a known fuel injection valve of the outward-opening type, with two rows of injection ports (varioregister nozzle) that can be uncovered in succession, in which the control according to the invention of the valve member stroke is realized.

To that end, the fuel injection valve has a valve body 1, which with its lower free end protrudes into the combustion chamber of the internal combustion engine to be supplied. The valve body 1 has an axial through bore 3, in which a pistonlike valve member 5 is guided axially displaceably. The valve member 5, on its lower end toward the combustion chamber, has a closing head 7 of enlarged cross section that protrudes from the bore 3 and forms a valve closing member. This closing head 7, shown enlarged in FIG. 2, with its annular end face oriented toward the valve body 1, forms a valve sealing face 9, which cooperates with a stationary valve seat face 11, which is formed on the end face, toward the combustion chamber and surrounding the bore 3, of the valve body 1. The valve sealing face 9 and valve seat face 11, which create a sealing cross section, are embodied conically; the cone angles of the two contact faces 9, 11 differ slightly from one another, so that a defined sealing edge is formed. Between the wall of the bore 3 and the shift of the valve member 5, an annular pressure chamber 13 is formed, which is defined toward the combustion chamber by an enlargement of the diameter of the valve member 5 that forms an annular shoulder 15 and by the transition from this to the closing head 7, and on the other by a cross-sectional enlargement 17 of the valve member 5 to the size of the bore 3. This pressure chamber 13 can be filled with fuel at high pressure via a pressure conduit 19; to that end, the pressure conduit 19 is connected, in a manner not shown in further detail, to an injection line of an injection pump. From the annular shoulder 15 defining the pressure chamber 13, injection conduits 21 lead away, initially being embodied as a longitudinal bore in the closing head 7 of the valve member 5, and from there control bores lead away at the level of the sealing edge. The outlet openings 23 (injection ports) of the injection conduits (21) are disposed above the valve sealing face 9 on the jacket face of the closing head 7 in such a way that in the closing position of the injection valve, that is, when the valve member 5 is on the valve seat 11, are covered by the wall of the bore 3 and are not uncovered until the outward-oriented opening stroke of the valve member 5 by emergence from the bore 3 of the valve body 1. In addition, preferably two rows (injection port rows) of outlet openings 23 are provided, the rows being disposed one above the other in the axial direction of the valve member 5; these outlet openings are uncovered in succession during the opening stroke motion of the valve member.

Alternatively, instead of the rows of injection ports one above the other, longitudinal slits are also possible as injection openings, whose cross section is then uncovered analogously in at least two stages.

The pistonlike valve member 5 protrudes with its shaft portion remote from the combustion chamber out of the valve body 1 into a bore of enlarged cross section, forming a spring chamber 25, in a valve holding body 27, which is braced axially against the valve body 1 by means of a lock nut 29. A valve closing spring 31 is fastened in the spring chamber 25 in such a way that it is braced with its end toward the combustion chamber against the valve body 1, and with its end remote from the combustion chamber it acts on a valve plate 33 on the valve member 5 and thus keeps the valve member 5 pressed into contact with the valve seat 11. The valve holding body 27 is also axially pierced by the pressure conduit 19, and a fuel filter 35 is inserted into the pressure conduit 19 on the upper end of the valve holding body 27.

To limit the outward-oriented opening stroke motion of the valve member 5, the valve member 5, on its end remote from the combustion chamber and protruding from the valve body 1 into the valve holding body 27, has a piston 37 that protrudes radially from the valve member shaft and defines a hydraulic damping chamber 39.

Figure 3:
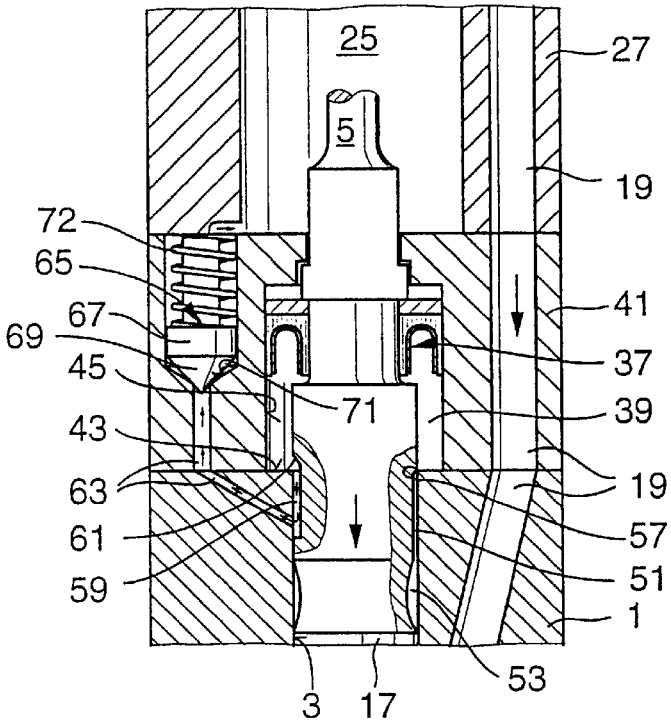
FIGS. 3 and 4 show enlarged details of a first exemplary embodiment of the fuel injection valve of FIG. 1 in the region of the damping chamber, with a valve in the relief line; the sectional view of FIG. 4 is rotated by 90° from the plane of the view in FIG. 3.
Figure 4:
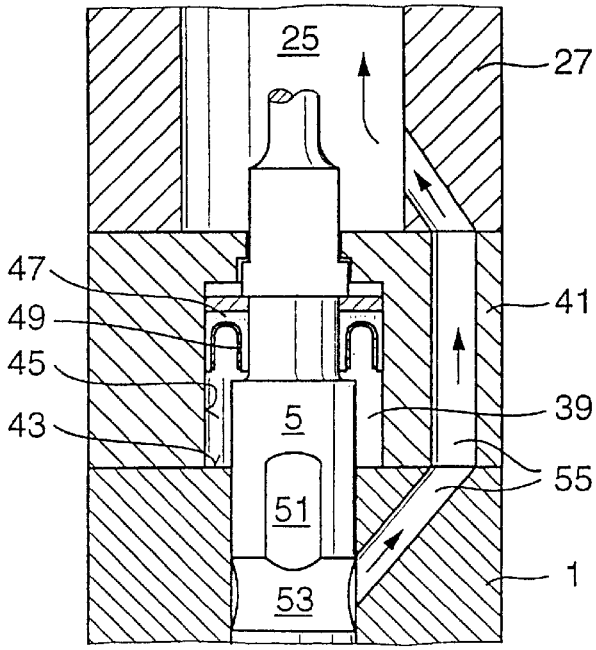

This damping chamber 39, as shown in the first exemplary embodiment in FIGS. 3 and 4, is provided according to the invention in a shim 41, which is fastened axially between an end face 43, remote from the combustion chamber, of the valve body 1 and the end face, toward the combustion chamber, of the valve holding body 27. The shim 41 has a portion of the pressure conduit 19 in the form of an axial through bore. The shim 41 also has a central through opening 45, through which the shaft of the valve member 5 protrudes and which radially outward defines the damping chamber 39. Axially, the damping chamber 39 is defined in the shim 41 by the end face 43 of the valve body 1 on one side and by the valve member piston 37 on the other. This piston 37 is formed by a sealing ring press-fitted onto the shaft of the valve member 5 and embodied as a U-shaped sealing ring 47 open toward the damping chamber 39. For fundamental sealing, a spring 49 is placed in this U-shaped sealing ring 47.

The filling and relief of the damping chamber 39 are effected via the fuel conduits, shown in FIGS. 3 and 4, which are connected to the low-pressure loop of the injection system, and for the purposes of explaining which the fuel injection valve is shown in FIG. 4 rotated by 90° compared to FIG. 3.

The filling and relief of the damping chamber 39 are effected via two polished sections on the valve member 5, which connect the damping chamber 39 to a low-pressure chamber, preferably the fuel-filled spring chamber 25, via relief conduits.

A first polished section 51 is disposed on the valve member 5 in such a way that with the injection valve closed, that is, when the valve member 5 is contacting the valve seat 11, it protrudes into its upper end into the damping chamber 39, which its lower end discharges into an annular groove 53 on the valve member 5. As shown in further detail in FIG. 4, this annular groove 53 sweeps over the orifice of a first relief conduit 55, which discharges, piercing the valve body 1, shim 41 and valve holding body 27, into the spring chamber 25. The upper end, remote from the combustion chamber, of the first polished section 51, with its upper boundary edge, forms a first control edge 57, which cooperates with the end face 43 of the valve body 1. When the first control edge 57 overtakes the end face 43, this is equivalent to a valve member opening stroke position in which the lower, first row of injection ports is uncovered, so that the spacing of the control edge 57 from the end face 43 is equivalent to a first opening stroke travel in a first opening stroke phase of the valve member 5. To enable averting vibration in the system, the first polished section 51 comes obliquely to an end in the direction of the first control edge 57. Offset from the first polished section 51, the valve member 5 has a second polished section 59, whose upper boundary edge, remote from the combustion chamber, forms a second control edge 61. With its lower end, toward the combustion chamber of the engine to be supplied, the second polished section 59 constantly covers the orifice of a second relief conduit 63, which likewise extends through the valve body 1, shim 41 and valve holding body 27 as far as the spring chamber 25. The second control edge 61 has a greater spacing from the end face 43 of the valve body 1 than the first control edge 57. The overtaking of the end face 43 by the second control edge 61 corresponds to the opening stroke position of the valve member 5 in which both rows of injection ports at the injection cross section are uncovered; after the second control edge 61 overtakes the end face 43, the damping chamber 39 is hydraulically closed in final form and thus determines the maximum opening stroke position of the valve member. For setting the second opening stroke phase, which follows the first opening stroke phase and an intermediate delay, a valve 65, which in the first exemplary embodiment is embodied as a check valve, is inserted into the second relief line 63. This valve 65, inserted into the portion of the second relief line 63 extending in the shim 41, has an axially displaceable, pistonlike valve member 67, which on its end toward the second polished section 59 has a conical sealing face 69, with which it cooperates with a valve seat face 71. A valve spring 72 acts on the back side of the valve member 67 and on the other side is braced in stationary fashion against the valve holding body 27; the opening pressure at the valve 65 can be set via the design of this spring. Via the opening pressure at the valve 65, the instant at which the second opening stroke phase at the valve member 5 is supposed to begin can be set, in the course of which phase the full opening cross section at the injection valve is uncovered. The second relief line 63 between the valve 65 and the second polished section 59 is also embodied at least in part as a throttle cross section.

Figure 5:
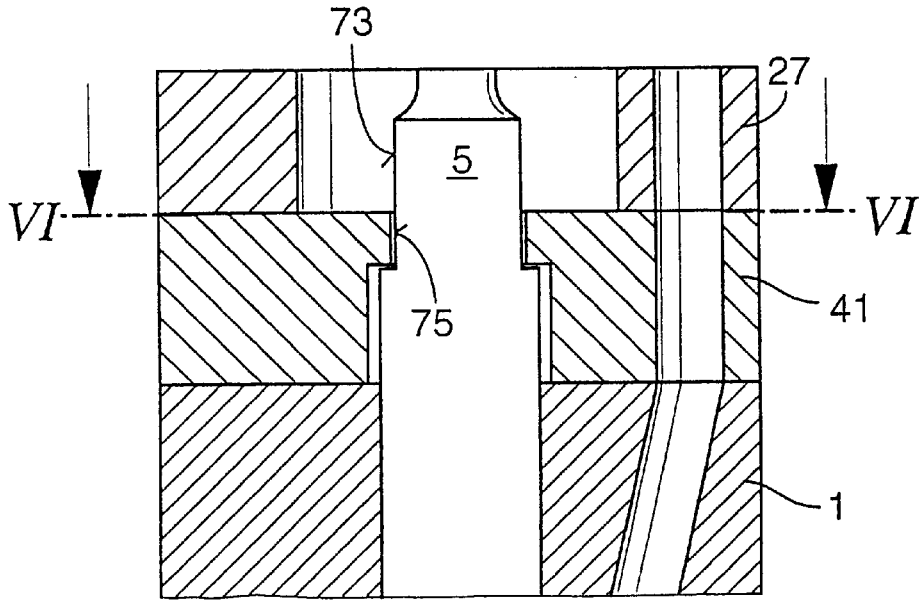
FIGS. 5 and 6 show two views of a torsion preventing means on the valve member of the fuel injection valve.
Figure 6:
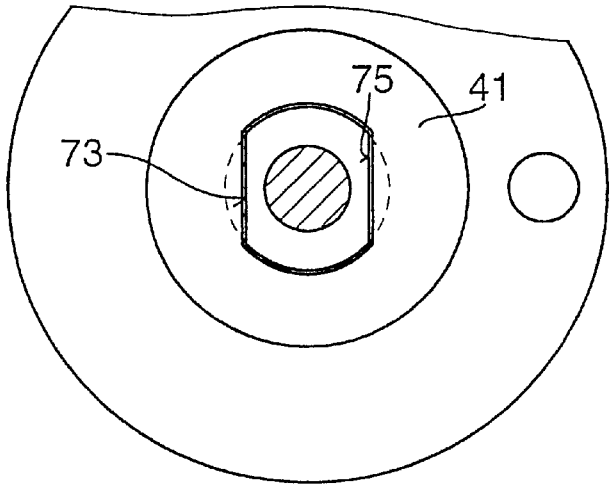

To prevent independent torsion of the valve member 5 and thus reliably to assure the connection between the polished sections 51, 59 and the inlet opening to the relief conduits 55, 63, a torsion preventing means is also provided on the valve member 5. This torsion preventing means, as shown in the two views in FIGS. 5 and 6, is embodied as an integrally formed profile 73 on the valve member 5, with which the valve member 5 protrudes into a complementary recess 75 in the shim 41.

The fuel injection valve of the invention functions as follows: In the closing position of the injection valve, the valve spring 31 keeps the valve member 5 with its valve sealing face 9 in contact with the valve seat 11; the piston 37 that defines the damping chamber 39 is in its outset position and the damping chamber 39 communicates via the first polished section 51, the annular groove 53 and the first relief conduit 55 with the fuel-filled spring chamber 25 (low-pressure chamber) and is filled from this chamber with fuel, which acts as a hydraulic working fluid. With the onset of injection, fuel which is at high pressure flows via the pressure conduit 19 into the pressure chamber 13, where in a known manner the fuel urges the valve member 5 at the annular shoulder 15 in the opening direction. Once a certain injection pressure has been reached in the pressure chamber 13, the pressure force of the fuel engaging the valve member 5 exceeds the restoring force of the valve spring 31, and the valve member 5 lifts outward away from the valve seat 11. After only a short idle stroke of the valve member 5, the outlet openings 23A of the lower row of injection ports of the injection conduits 21 are already uncovered, so that the fuel is injected into the combustion chamber of the engine to be supplied. This first opening stroke phase is ended when the first control edge 57 at the first polished section 51 overtakes the end face 43 of the valve body 1, and once the first polished section has plunged all the way into the valve body 1, the damping chamber 39 is briefly closed and then acts as a hydraulic damper, which blocks any further opening stroke motion of the valve member 5. The valve member 5 stays in this position, which uncovers a partial opening cross section at the injection valve, in a first operating mode of the injection valve, which corresponds to the idling range and a partial-load range of the engine to be supplied.

If at higher load or higher engine rpm the entire opening cross section at the injection valve is to be uncovered, then the second operating mode of the injection valve is selected. In this case, the valve member 5 stays only briefly in the intermediate position, while at the same time the fuel injection pressure continues to rise in the pressure chamber 13 of the injection valve.

Once a second limit value of the opening pressure in the pressure chamber 13 is exceeded, the force engaging the annular shoulder 15 in the opening direction of the valve member 5, and in proportion with it the pressure in the damping chamber 39, exceed the force holding the valve 65 in the second relief conduit 63 closed, this relief conduit previously having been in constant communication with the damping chamber 39. With the opening of the valve 65, some of the pressure fluid is again released from the damping chamber 39 via the second polished section 59 and the second relief conduit 63 into the spring chamber 25, so that the valve member 5 continues the opening stroke motion in a second opening stroke phase. Now the upper outlet openings 23B of the injection conduits 21 are uncovered, so that now both rows of injection ports and thus the entire injection cross section are uncovered. To enable more precise control of this second opening stroke phase, the fuel flowing out via the second polished section 59 is throttled upstream of the valve 65 in the second relief conduit 63.

The opening stroke motion of the valve member 5 is ended when the second control edge 61 at the second polished section 59 overtakes the end face 43 of the valve body 1; the damping chamber 39 is now hydraulically closed in final form and thus limits the opening stroke motion of the valve member. This attainment of the maximum opening stroke stop advantageously occurs in damped form, and the degree of damping at the valve member depends on the modulus of elasticity of the fuel.

In the ensuing closing stroke of the valve member 5 that follows the termination of high-pressure fuel delivery, the polished sections 51 and 59 return to coincidence with the damping chamber 39, so that the damping chamber is refilled with fuel from the spring chamber 25, via the first polished section 51 and the first relief conduit 55.

With the arrangement according to the invention of a valve in the second relief conduit, the dwelling between the two opening stroke phases and the second opening stroke phase of the valve member can both be set very precisely; between the two operating modes of the injection valve (the half-open injection cross section and the fully open cross section), at least one injection occurs.

Alternatively, by providing further hydraulic stops, other intermediate positions of the opening stroke position of the valve member are possible.

The second exemplary embodiment shown in FIG. 7 analogously to the view in FIG. 3 differs from the first exemplary embodiment by having direct control of the valve 65 in the relief conduit 63. The valve member 67 has a piston rod 77, which is secured to an actuator 79 of a piezoelectric adjuster which is braced, securely attached to the housing, in the closing direction of the valve member 67. The valve spring 72 acts on the piezoelectric actuator 79 and prestresses it and keeps the valve member 67 in contact with the valve seat. The electrical triggering of the piezoelectric actuator 79 is effected as a function of a performance graph of the engine to be supplied and as a function of the instantaneous instant of the injection, and an adjustment is even possible during an injection event.

The connection between the piezoelectric actuator 79 and the valve member 67, 77 can also be made via transmission elements.

In the third exemplary embodiment shown in FIG. 8, the valve member 67 of the valve 65 in the second relief conduit 63 is effected via a magnetic valve; the rod 77 of the pressure valve member 67 is connected to an armature 81 or forms a part of it. This armature 81 protrudes into a coil 83, through which current flows, of the magnetic valve, so that by the controlled change in the electrical voltage applied, the location of the armature 81 and thus of the valve member 67 can be set. The basic setting of the valve can be made by means of a setting spring 85 that is in addition to the valve spring 72.

In the fourth exemplary embodiment shown in FIG. 9 of the fuel injection valve of the invention, the setting of the valve 65 in the second relief conduit 63 is effected by applying a settable hydraulic counterpressure to the back side, toward the spring, of the valve member 67. This pressure, counteracting the pressure in the damping chamber 39, is built up in a manner not shown in detail in an additional hydraulic system and delivered to the valve 65 via the control line 87. The opening motion of the valve member 67 is thus settable by means of the pressure difference between the damping chamber 39 and the counterpressure in the control line 87, which is additional to the force of the valve spring 72.

Figure 10:
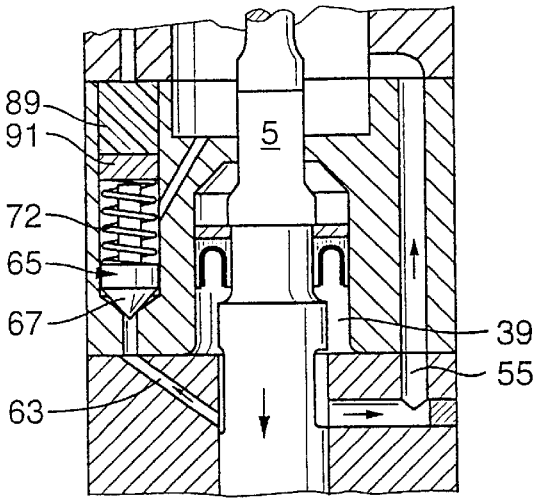
FIG. 10 shows a fifth exemplary embodiment, in which the adjustment of the spring prestressing force of the valve in the relief line is effected via a piezoelectric actuator.
Figure 11:
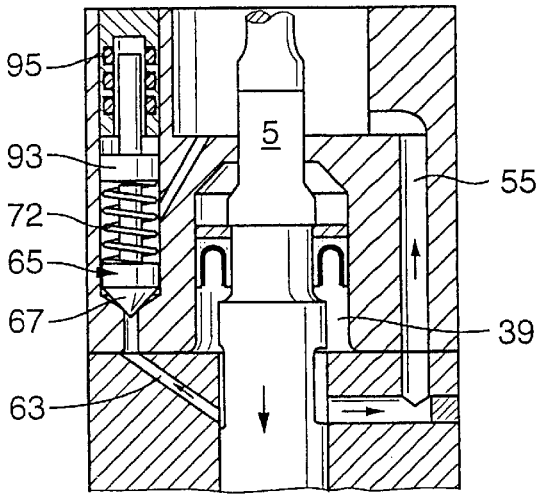
FIG. 11 shows a sixth exemplary embodiment, in which the adjustment of the spring prestressing force of the relief valve is effected via a magnet armature.
Figure 12:
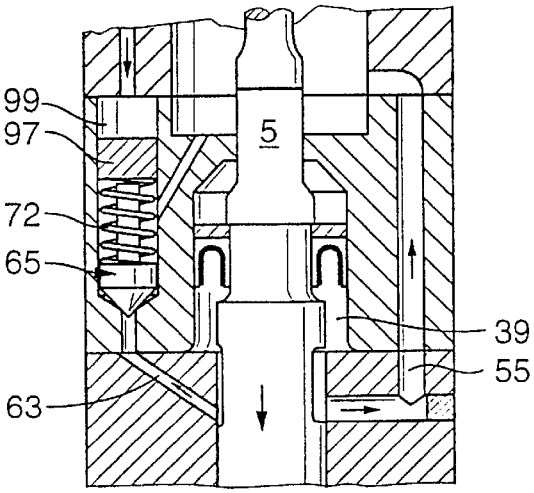
FIG. 12 shows a seventh exemplary embodiment, in which the adjustment of the spring prestressing force of the relief valve is effected via a hydraulic control piston.

In the exemplary embodiments shown in FIGS. 10–12, the setting of the opening instant or the closing characteristic at the valve 65 in the second relief conduit 63 is effected via the performance-graph-dependent adjustment of the spring prestressing force.

This adjustment of the spring prestressing force is effected, in a fifth exemplary embodiment shown in FIG. 10, by means of a piezoelectric actuator 89, which is inserted above the valve member 67 into the spring chamber of the valve 65 and is prestressed by the valve spring 72; the valve spring 72 is braced directly on the piezoelectric actuator 89 via an adjusting shim 91.

By a suitably controlled supply of electric current to the piezoelectric actuator 89, its axial length and thus the spring prestressing force of the valve spring 72 can now be set.

In the sixth exemplary embodiment, shown in FIG. 11, the setting of the spring prestressing of the valve spring 72 of the valve 65 in the second relief conduit 63 is effected by a magnet armature 93, which is guided axially displaceably in a coil 95 through which current flows. The pistonlike armature 93 with its end face toward the valve, forms a spring bearing face, on which the valve spring 72 is supported; this spring on its other end engages an annular shoulder of the valve member 67.

By varying the electrical voltage of the coil 95, the axial location of the armature 93 and thus the prestressing force of the valve spring 72 can now be set.

FIG. 12 shows a seventh exemplary embodiment, in which the axial adjustment of the spring bearing face of the valve spring 72 of the valve 65 in the second relief conduit 63 is effected hydraulically. To that end, the spring bearing face is provided on a piston 97, on one end face of which the valve spring 72 rests and whose other face end, remote from it, defines a hydraulic work chamber 99. This work chamber 99 can be filled with a hydraulic fluid that is under pressure via a control line 101 from a hydraulic system; the pressure delivery can be set as a function of the operating performance graph of the engine. The axial adjustment of the piston 97 and thus the adjustment of the prestressing force of the valve spring 72 are now effected by the controlled delivery of pressure or pressure relief in the work chamber 99.

Figure 13:
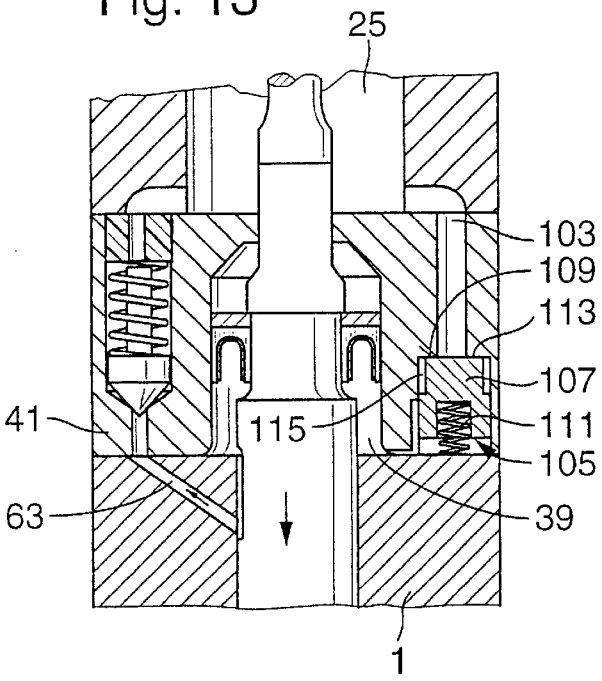
FIGS. 13 and 14 show an eighth exemplary embodiment in two views, in which an additional check valve is inserted into an inlet line of the damping chamber.
Figure 14:
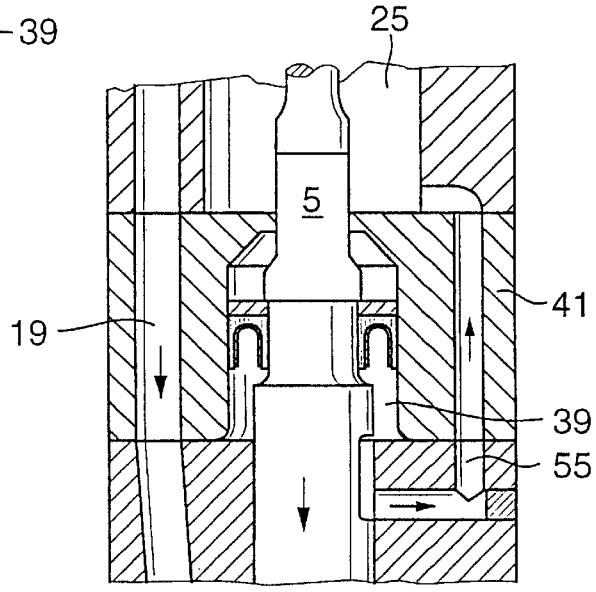

The eighth exemplary embodiment shown in two views in FIGS. 13 and 14, has, in addition to the previous exemplary embodiments, a further inlet line 103 in the shim 41, and this line, beginning at the spring chamber 25 filled with fuel at low pressure, discharges constantly into the damping chamber 39. A check valve 105 that opens in the direction of the damping chamber 39 is inserted into this inlet line 103, and its valve member is embodied as a stepped piston 107. The stepped piston 107, with its end face toward the spring chamber, forms a sealing face 109, with which it is held by a check valve spring 111 in contact with a valve seat face 113. The check valve spring 111 is braced in stationary fashion on the valve body 1 and acts upon the stepped piston 107 on the face end thereof remote from the spring chamber 25. The stepped piston 107 is designed such that even before the contact with the valve seat 113, it plunges sealingly with its larger circumferential face into the smaller diameter of a stepped receiving bore 115, so that the check valve 105 closes even before the contact with the valve seat 113. The prestressing force of the check valve spring 111 is designed to be so low that the stepped position 107 is not displaced into contact with the valve seat 113 until there is a pressure equilibrium between the spring chamber 25 and the damping chamber 39.

The check valve 105 thus opens, as long as the pressure in the damping chamber 39 is less than the leaking oil pressure in the spring chamber 39, so that reliable filling of the damping chamber 39 and an avoidance of negative pressure during the closing stroke motion of the valve member 5 of the injection valve are assured. Once a pressure equilibrium exists between the spring chamber 25 and the damping chamber 39, the check valve 105 closes, and the stepped piston is pressure-balanced at this moment.

Figure 15:
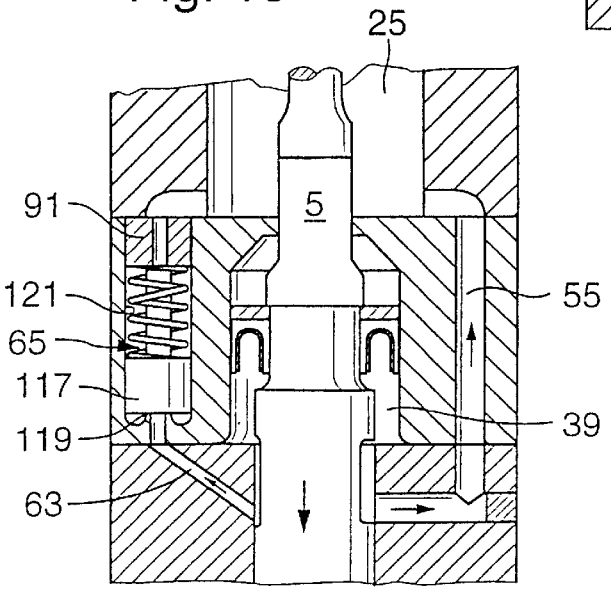
FIG. 15 shows a ninth exemplary embodiment, in which the valve member of the valve in the relief line is embodied as a deflection piston.

In the ninth exemplary embodiment, shown in FIG. 15, the valve member of the valve 65 in the second relief conduit 63 is embodied as a deflection piston 117. To that end, the valve seat of the valve 65 is embodied as a conical cuff feature 119, with which the deflection piston 117 comes into contact with its plane end face in such a way that a residual volume remains in the valve chamber. The deflection piston 117 is guided sealingly with its circumferential face along the wall of a valve chamber 121 that receives the valve 65 and is urged in the closing direction in a known manner by the valve spring 72, which is braced against a shim 91.

The deflection piston 117, upon the opening of the valve 65, makes a deflection volume available in the valve chamber 121, as a result of which the pressure in the damping chamber 39 drops in such a way that the second opening stroke phase at the valve member 5 can occur, and the full injection cross section of the injection valve is uncovered.

In the return motion of the valve member 5 and with the closure of the valve 65, the deflection-volume is now fed back into the damping chamber 39, which reinforces the refilling of the damping chamber 39, and thus the deflection piston 117 also takes on the function of a check valve. The foregoing relates to preferred exemplary embodiments of the invention, it being understood that other variants and embodiments thereof are possible within the spirit and scope of the invention, the latter being defined by the appended claims.

What is claimed is:

1. A fuel injection valve for internal combustion engines, comprising a valve member (5) that is axially displaceable outward counter to a restoring force in a bore (3) of a valve body (1) and that on an end toward the combustion chamber has a closing head (7), forming a valve closing member, that protrudes out of the bore (3), the closing head having a valve sealing face (9), on a side toward the valve body (1), with which the valve sealing face cooperates with a valve seat face (11) disposed on the face end toward the combustion chamber of the valve body (1), at least one injection opening (21), beginning at a pressure chamber (13), on the closing head (7), whose outlet opening (23) is covered, in the closing position of the valve member (5), by the valve body (1) and uncovered upon the outward-oriented opening stroke, and having a two-stage hydraulic stroke stop which limits the opening stroke motion of the valve member (5) and is embodied as a hydraulic damping chamber (39) with an operable relief line, wherein the relief line communicates with the damping chamber (39) via at least two recesses on the valve member (5) which are operable in succession during the opening stroke motion of the valve member (5), at least one of the recesses communicates with a low-pressure chamber, via a relief conduit (63) that includes a valve (65).

2. The fuel injection valve according to claim 1, in which the outlet openings (23) of the injection conduits (21) are uncovered variably during the opening stroke motion of the valve member (5) and are embodied as two rows of injection ports disposed axially one above the other on the valve member (5), of which, after a traversal of a first opening stroke phase of the valve member (5), only a first, lower row of injection parts, near the combustion chamber, of outlet openings (23A) is uncovered, while the second, upper row of outlet openings (23B) is not uncovered until during a course of a second opening stroke phase of the valve member (5).

3. The fuel injection valve according to claim 1, in which the recesses on the valve member (5) are embodied as plane polished sections, whose upper ends, toward the combustion chamber, form control edges which cooperate with an end face (43) of the valve body (1), which end face axially defines the damping chamber (39).

4. The fuel injection valve according to claim 3, in which a first polished section (51) is embodied as an oblique place polished section, whose lower end, toward the combustion chamber and machined to a greater depth, protrudes constantly into an annular chamber (53), formed between the valve member (5) and the bore (3) and communicating with the lower-pressure chamber, and which with a shallowly tapering, axially upper end, when the valve member (5) is seated on ten valve seat (11), discharges into ten damping chamber (39), and the edge on the upper end, remote from the combustion chamber, of the first polished section (51) forms a first control edge (57).

5. The fuel injection valve according to claim 3, in which a second polished section (59) is provided, whose axially upper end, remote from the combustion chamber, forms a second control edge (61) and whose lower axial end, oriented toward the combustion chamber, communicates constantly with the relief conduit (63) that contains the valve (63).

6. The fuel injection valve according to claim 4, in which the first and second control edges (57, 61) are axially offset in height from one another on the valve member (5) in such a way that the first control edge (57), after a first opening stroke phase of the valve member (5) has been traversed, is opened while the second control edge (61) is not closed by the end face (43) of the valve body (1) until after a total opening stroke travel of the valve member (5) has been transversed.

7. The fuel injection valve according to claim 5, in which the first and second control edges (57, 61) are axially offset in height from one another on the valve member (5) in such a way that the first control edge (57), after a first opening stroke phase of the valve member (5) has been traversed, is opened while the second control edge (61) is not closed by the end face (43) of the valve body (1) until after a total opening stroke travel of the valve member (5) has been transversed.

8. The fuel injection valve according to claim 1, in which the damping chamber (39) is provided in a shim (41) that is fastened between the valve body (1) and a valve holding body (27).

9. The fuel injection valve according to claim 3, in which the damping chamber (39) is defined, on an axial end opposite the end face (43) of the valve body (1), by a piston (37), which is secured to the valve member (5) and is guided on an outer circumference in a sealing, slidingly displaceable manner along a wall of the damping chamber (39).

10. The fuel injection valve according to claim 8, in which the damping chamber (39) is defined, on an axial end opposite the end face (43) of the valve body (1), by a piston (37), which is secured to the valve member (5) and is guided on an outer circumference in a sealing, slidingly displaceable manner along a wall of the damping chamber (39).

11. The fuel injection valve according to claim 10, in which the piston (37) is embodied as a U-shaped sealing ring (47), which is open toward the damping chamber (39) and is press-fitted onto the shaft of the valve member (5).

12. The fuel injection valve according to claim 11, in which a spring (49) is placed in the U-shaped sealing ring (47).

13. The fuel injection valve according to claim 8, in which the valve (65) is disposed in the slim (41).

14. The fuel injection valve according to claim 5, in which a throttle restriction precedes the valve (65) in the relief conduit (65).

15. The fuel injection valve according to claim 1, in which a torsion preventing means to prevent independent torsion is provided on the valve member (5) of the injection valve.

16. The fuel injection valve according to claim 15, in which the torsion preventing means is formed by an integrally formed profile (73) on the valve member (5) and a recess (75) complementary to said profile in the housing.

17. The fuel injection valve according to claim 1, in which the valve (65) in the relief conduit (63) is settable by means of an electric final control element.

18. The fuel injection valve according to claim 17, in which the final control element is embodied as a piezoelectric actuator (79).

19. The fuel injection valve according to claim 17, in which the final control element is embodied as a magnet valve, and an armature (81) of the magent valve, protrudes into a coil (83) through which current flows, is connected to a valve member (67) of the pressure valve (65).

20. The fuel injection valve according to claim 1, in which the opening of the valve (65) in the relief conduit (63) is controllable by means of a settable hydraulic counter pressure on a side of a valve member (67) of the valve (65) remote from the damping chamber (39).

21. The fuel injection valve according to claim 1, in which the opening pressure at the valve (65) in the relief conduit (63) is continuously settable via an adjustment of the spring prestressing force of a valve spring (72).

22. The fuel injection valve according to claim 21, in which the adjustment of the spring prestressing force at the valve (65) is effected by means of an axial displacement of a spring bearing face.

23. The fuel injection valve according to claim 22, in which the spring bearing face is displaced by means of a piezoelectric adjuster (89).

24. The fuel injection valve according to claim 22, in which the spring bearing face is displaced by means of an electromagnetic armature (93) disposed in a coil (95).

25. The fuel injection valve according to claim 22, in which the spring bearing is displaced by means of a hydraulic piston (7).

26. The fuel injection valve according to claim 1, in which a check valve (105), opening in a direction of the damping chamber (39), is inserted into an inlet line (103) of the damping chamber (39), which line originates in the low-pressure chamber.

27. The fuel injection valve according to claim 1, in which the valve member of the valve (65) in the relief conduit (63) is embodied as a deflection piston (117), which upon its opening stroke motion makes a defined deflection volume available in the valve chamber (121) of the valve (65).

28. The fuel injection valve according to claim 27, in which a valve seat face of the deflection piston, guided sealingly in the valve chamber (121) is embodied as a conical cuff feature (119).

* * * * *